US005967457A

United States Patent [19]

Wildenberg et al.

[11] Patent Number: 5,967,457

[45] **Date of Patent: *Oct. 19, 1999**

[54] AIRFOIL WEB STABILIZATION AND TURNING APPARATUS AND METHOD

[75] Inventors: Henry N. Wildenberg, Kaukauna; Douglas S. Stenz, Appleton, both of Wis.

[73] Assignee: Thermo Wisconsin, Inc., Kaukauna, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/895,946

[22] Filed: Jul. 17, 1997

Related U.S. Application Data

[63] Continuation-in-part of application No. 08/685,086, Jul. 23, 1996, abandoned.

[51] Int. Cl.[6] ..... B65H 57/00; B65H 20/00

[52] U.S. Cl. ..... 242/615.4; 226/97.3; 242/61.5; 242/615.12

[58] Field of Search ..... 226/97.3; 242/615, 242/615.11, 615.12, 615.4; 34/120

[56] References Cited

U.S. PATENT DOCUMENTS

| | | | |
|---|---|---|---|
| 3,398,870 | 8/1968 | Mullan et al. | 242/615.11 |
| 3,813,019 | 5/1974 | McAnespi et al. | 242/615.11 |
| 3,999,696 | 12/1976 | Reba et al. | 242/615.11 X |
| 4,147,287 | 4/1979 | Reba | 226/97.3 X |
| 4,186,860 | 2/1980 | Reba | 226/97.3 X |
| 4,321,107 | 3/1982 | Page | 242/615.11 X |
| 4,726,502 | 2/1988 | Cryderman | 226/97.3 |
| 4,767,042 | 8/1988 | Daane | 242/615.11 |
| 4,913,049 | 4/1990 | Sainio | 226/7 |
| 5,022,166 | 6/1991 | Nguyen et al. | 242/615.11 X |
| 5,317,817 | 6/1994 | Roberts et al. | 242/615.12 |
| 5,370,289 | 12/1994 | Helms | 242/615.11 |
| 5,577,294 | 11/1996 | Pollock | 242/615.11 X |

FOREIGN PATENT DOCUMENTS

| | | |
|---|---|---|
| 0461812 | 12/1991 | European Pat. Off. . |
| 0675064 | 10/1995 | European Pat. Off. . |
| 9109313 | 9/1991 | Germany . |
| 29508421 | 9/1995 | Germany . |

*Primary Examiner*—Michael Mansen
*Attorney, Agent, or Firm*—Samuels, Gauthier & Stevens

[57] ABSTRACT

An apparatus and method for stabilizing and changing the direction of a web moving in a web path between web handling devices. The apparatus includes an airfoil having a bulbous front end tapering to a narrowed rear end, the airfoil having first and second oppositely facing surfaces. A coplanar surface extends from the rear end of the airfoil to define an active surface with the second surface of the airfoil. The web is arranged to move in spaced relation with and along the active surface such that the interaction between the active surface and the boundary layer air associated with the moving web serves to both stabilize and alter the direction of the boundary layer air and the moving web.

31 Claims, 16 Drawing Sheets

FIG. 7
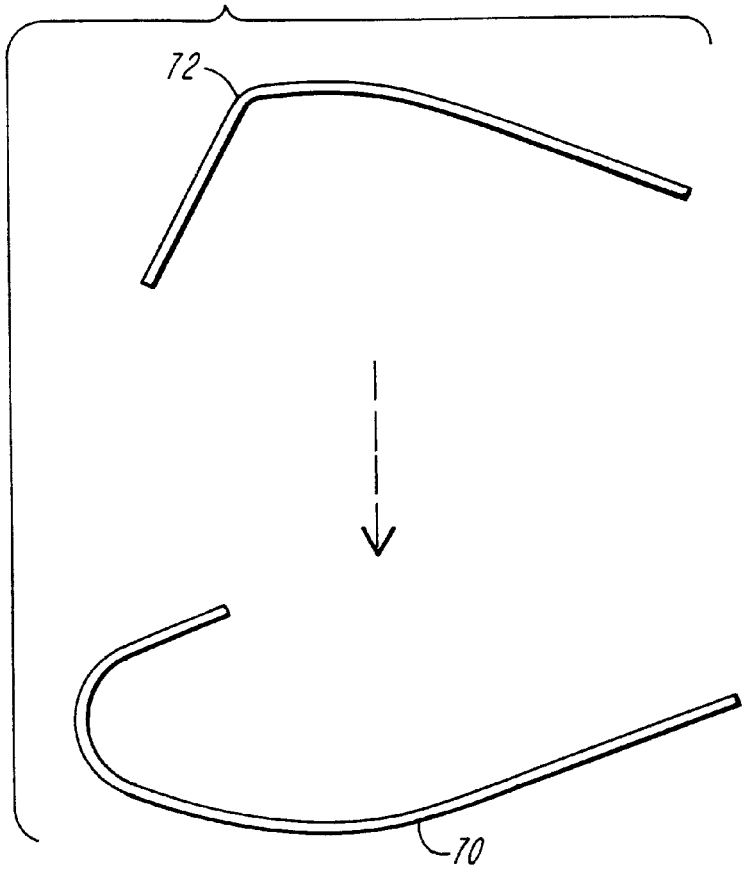
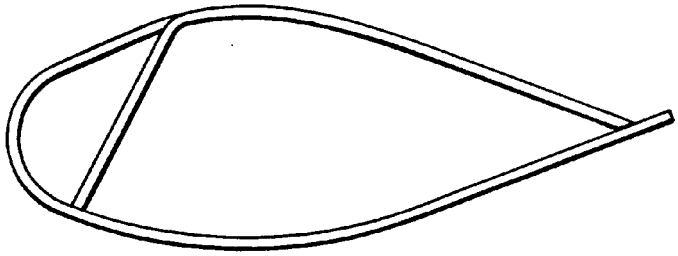
FIG. 7B

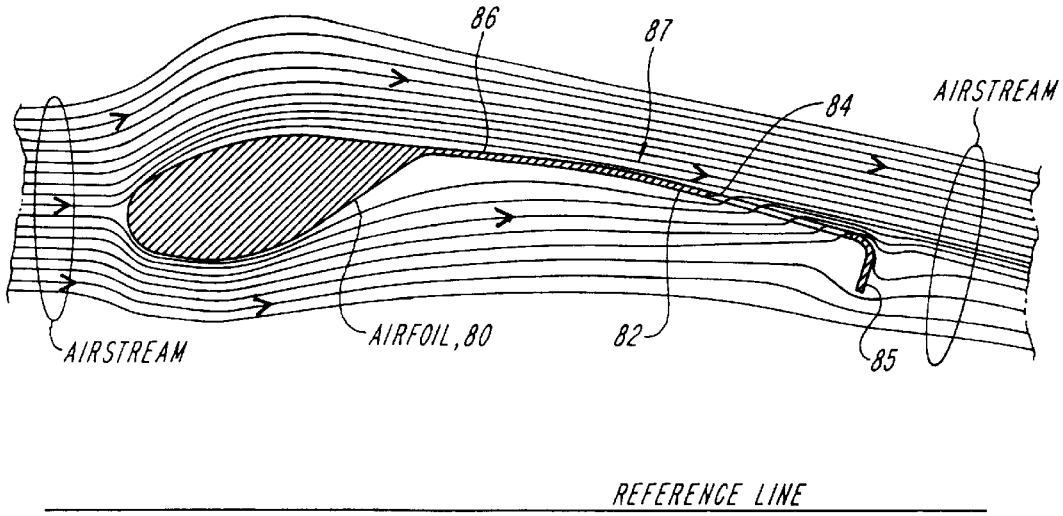
FIG. 8
FIG. 9
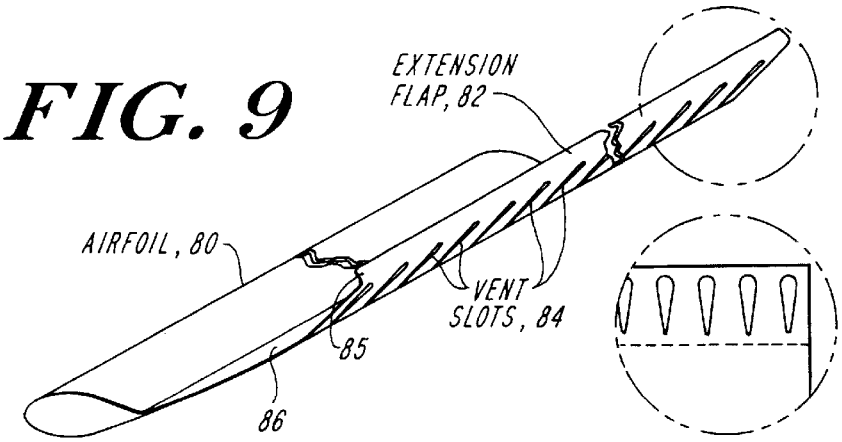
FIG. 9A

AIRFOIL WEB STABILIZATION AND TURNING APPARATUS AND METHOD

This application is a continuation-in-part of U.S. patent application Ser. No. 08/685,086 filed Jul. 23, 1996, now abandoned.

BACKGROUND OF THE INVENTION

The invention relates to a non-powered web stabilization apparatus in which an airfoil is specifically configured to utilize the boundary layer air associated with a moving web to stabilize the web and to assist changes to the web path as desired with minimal friction and without the use of externally supplied air.

In the manufacture of tissue (light weight, porous paper), there generally is a spacial separation (draw) between the exit from the dryer section of the paper machine, such as the Yankee cylinder dryer, and the winder area where the paper is wound into rolls for subsequent further processing at some location typically remote to the paper manufacturing machinery. This spacial separation provides isolation of the winder from the paper machine, while accommodating intermediate operations such as calendaring (bulk uniformity control), slitting (cutting the "as manufactured" paper width into multiple narrower widths), caliper control (real time measurement and adjustment of paper unit weight and/or moisture), and repulping (gathering, shredding and reconstituting as recycled pulp) that paper which is not being wound, such as at start-up or at a web break. Each of these intermediate operations has a stabilizing effect on the web, while at the same time may place special requirements on the position and steadiness of the web. Since these devices may or may not be continuously in use, a means must be provided in the web path to compensate for the non-use condition.

Historically, various means have been employed to control the web as it passes from the paper machine dryer section to the winder. These include bowed pipes or rolls, straight pipes or rolls, and large flat plates or other similar devices. The nature of tissue is such that it has substantial bulk with the surface being comprised to a multitude of pulp fibers radiating outwardly. These fibers are readily broken by firm contact with stationary rigid devices such as rolls or pipes, resulting in the production of an extremely fine paper dust which presents both a fire hazard situation, as well as a health hazard for the workers through ingestion into the lungs. The quantity of this dust present in the work-place air is now subject to Federal and State regulation, and its generation is an issue of concern. Ideally, physical contact with the virgin web should be avoided entirely, but this is neither practical or possible.

The most popular means of changing the web path through the tissue manufacturing process is the rigid pipe, whether bowed or straight, due to its simplicity and minimum cost. The pipe method has three major problems inherent in its use. The first is that the web is in firm contact with the pipe, thus requiring additional tension to be applied to the web. Secondly, since paper is abrasive (even soft, delicate tissue) the pipe will become worn and require replacement periodically. Thirdly, once the web is in contact with the pipe, it wants to remain attached to the curved surface of the pipe, thus requiring additional tension to break the web loose. Typically, dust particles will collect near the breakaway point, forming an extension of the pipe which eventually breaks off, falling onto the web and either contaminating the web or breaking it. The simple rigid pipe is effective in controlling the web and reducing web vibrations, although it does require frequent cleaning and periodic replacement.

Another popular web stabilizer and web transport system is the large flat plate style. These plates are typically several feet in machine direction length and are effective at holding webs which are subject to very strong air currents such as those emitted from the broke pit of the repulper system. Since this large flat plate generally occupies the majority of the draw between the dryer cylinder and the next machine element, it must be moved at time of start-up or web break to provide an unobstructed path for the web traverse to the repulper system broke pit. Movement of this plate requires the use of a mechanically driven member which adds to the total system complexity. The flat plate style exhibits two problems which are detrimental. First, the machine direction length is such that the web can alternately collapse against the surface of the plate, then pick up from the plate and subsequently collapse again (flutter), resulting in the generation of dust due to physical contact which in turn adds to the total web tension. Also, to provide sufficient structural rigidity, the plate must be made with some finite thickness to accommodate the inclusion of internal structural reenforcement. As a result of this thickness, the entry and exit ends are shaped (generally rounded) to facilitate smooth entry and exit. The behavior of these curved ends is similar to that of the rigid pipe design, except that the tendency for web attachment to the adjacent surface is more aggressive because the radius employed is greater than that of the typical rigid pipe.

Accordingly, it is an object of the invention to provide a non-powered web stabilization apparatus to overcome the aforementioned deficiencies in conventional devices.

SUMMARY OF THE INVENTION

The machinery used in the manufacture of webs of material such as tissue (light weight, porous paper) is usually arranged in such a fashion as to result in a length of span where the moving web is neither in contact with or under direct control of the machinery. In these draws between machine elements, the moving web is subject to influence by random air currents, with that influence becoming more disruptive as the distance increases. Since the web is typically moving at a high speed (4000 to 6000 feet per minute), it induces movement of the air adjacent to and on both sides of the web. This boundary layer air travels in the same direction as the web and at a speed approaching that of the web. By immersing a specifically designed airfoil stabilizer in this boundary layer, the web is drawn toward and held in close proximity to its adjacent surface and in turn the web path may be altered by altering the orientation of the stabilizer. The non-powered airfoils can be employed to stabilize the web before it physically contacts the next machine element, as well as for angular changes in web path direction.

Accordingly, in one embodiment of the present invention there is provided an apparatus and method for stabilizing and changing the direction of a web moving in a web path between web handling devices. The apparatus includes an airfoil having a bulbous front end tapering to a narrowed rear end, the airfoil having first and second oppositely facing surfaces. A coplanar surface extends from the rear end of the airfoil to define an active surface with the second surface of the airfoil. The web is arranged to move in spaced relation with and along the active surface such that the interaction between the active surface and the boundary layer air associated with the moving web serves to both stabilize and alter the direction of the boundary layer air and the moving web.

BRIEF DESCRIPTION OF THE DRAWINGS

FIG. 7A is a side sectional view of an airfoil in a disassembled state;

FIG. 7B is a side sectional view of an airfoil in an assembled state;

FIG. 8 shows a side view schematic airflow diagram for an exemplary airfoil web stabilizer in accordance with the invention;

FIG. 9 shows a perspective view of the exemplary airfoil web stabilizer in accordance with the invention;

DETAILED DESCRIPTION OF THE ILLUSTRATED EMBODIMENTS

For purposes of illustration, the invention will initially be described with respect to a web in a paper making machine. In the draws between machine elements, a moving web is subject to influence by random air current, with that influence becoming more disruptive as the distance increases. Since the web is typically moving at a high speed (4000 to 6000 feet per minute) it induces a movement of the air adjacent to and on either side of the web. The momentum of this boundary layer air begins to build immediately after the web leaves a machine element (such as the dryer) and continues to travel in the same direction as the web until the next machine element or device (such as the calendar) is encountered.

Figure 1:
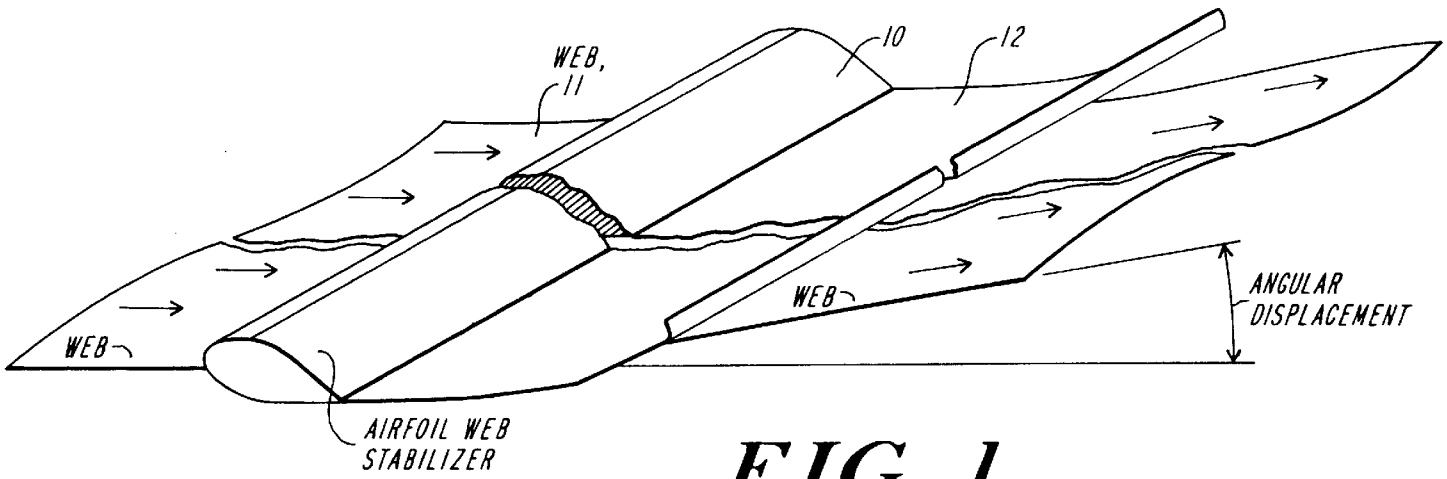
FIG. 1 shows an exemplary embodiment of an airfoil web stabilizer in accordance with the invention.

This boundary layer air moves at a speed approaching that of the web, with that speed gradually diminishing as the distance from the web is increased. In accordance with an exemplary embodiment of the invention, a specifically designed airfoil web stabilizer 10 is immersed in the boundary layer of the web 11 as shown in FIG. 1. Thus, the web is controlled by being held in close proximity to the stabilizer and in turn the web path can be changed by altering the orientation of the stabilizer. The airfoil 10 can be employed to stabilize the web before entering the next machine element, as well as to affect an angular change in web path direction.

By placing a series of airfoils 10 at intervals along the web path, control of the web can be maintained, minimizing the potential for web breaks, wrinkles and other defects. Since excessive web tension is a detriment to product quality, the tension employed to pull the web to the winder should be held to that minimum required to maintain control of the web. The use of airfoils to manage the web path results in the minimization of tension without compromising web stability and control.

Figure 2:
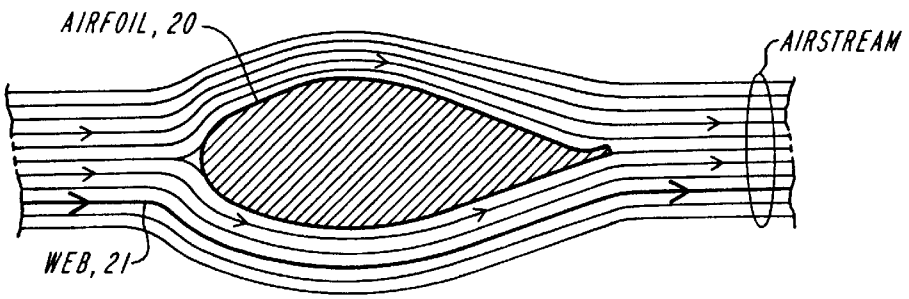
FIG. 2 shows a side view schematic airflow diagram for an exemplary airfoil.

In accordance with an initial embodiment of the invention, an airfoil web stabilizer 20 design as shown in FIG. 2 was applied to stabilize a tissue web 21 before it entered the cleaner system which was employed to remove loose paper fiber particles from the tissue during the manufacturing process. Stabilization of the web at this point in the process is critical, since any folds or wrinkles entering the cleaner would be made permanent and render the tissue as being unsuitable for final conversion into a marketable product. The airfoil 20 conceived for this application is a nearly symmetrical airfoil (same shape above and below the lengthwise centerline) with a length to thickness ratio of approximately 3. This design is light in weight, strong, easily mounted and able to be bowed if necessary to accommodate web distortions.

Although the design of airfoil 20 functions well as a stabilization device when positioned immediately preceding a web path machine element, additional potential for its use as a supplement to existing web handling devices necessitates revision of the design to increase the force generation potential. This is achieved by extending the length of the airfoil with an extended active surface 12 and terminating it in such a fashion as to provide for a stable release of web from that force as shown in FIG. 1. The benefits of the extended active surface will be described in more detail hereinafter.

The underlying principle of the airfoil web stabilizer of the invention is the "airfoil", which by definition is a "body designed to provide a desired reaction force when in motion relative to the surrounding air". Although this airfoil definition is generally applied to an aircraft which is in motion relative to the surrounding air, in this application the airfoil is stationary and the air is in motion relative to it. In both cases, the reaction force results from the physical act of displacing the air from the path it had been on and redirecting it.

Airfoils can be of almost any shape and still create a reaction force of some magnitude. Airfoils can range from a simple flat plate (panels of box-kite), to a curved plate (sail on a sailboat), to a complex shape (wing on an aircraft) which has some finite thickness resultant from the combination of upper and lower surfaces of different curvature. The reaction force is generated by both changing direction of the airstream (conservation of momentum) and by splitting an airstream into two parts and forcing each of these streams to take a path of a different length to get past the airfoil before reuniting to form a single airstream again. The airstream traveling the greatest distance must increase in velocity if it is to rejoin the airstream traveling the shorter distance, in order to restore the original airstream mass. The act of one airstream moving faster than the other results in a lower pressure in that airstream when compared to the slower airstream on the opposite side. This phenomenon is called the Bernoulli principle, and it is this differential in pressure which creates a portion of the desired reaction force typically associated with airfoils.

The magnitude of this reaction force is related to five factors: (1) the shape of the air foil; (2) the angle of the airfoil relative to the airstream (angle of attack); (3) the velocity of the airstream; (4) the area of the airfoil; and (5) the density of the air. In applying these factors to the task of managing the somewhat fragile tissue web which happens to be traveling at high speed, the variability and influence of each of these factors must be considered. Since an objective of the invention is to manage the traverse of the web, an airfoil is used to redirect the boundary layer airstream, since part of this airstream is the flexible tissue web which is the object we ultimately intend to control.

Although the tissue web is considered to be moving at high speed, in terms of aerodynamics the typical speed range of from 60 to 100 feet per second is considered slow. The use of an aerodynamic device is further complicated by the fact that the velocity of the boundary layer airstream relative to the stationary airfoil decreases as the perpendicular distance from the web increases, although once the web is under the influence of the airfoil, it will be drawn into close proximity where the airstream speed closely approximates that of the web. The paper machine used in the tissue manufacturing process is generally operated at a continuous speed and temperature to optimize product quality and throughput, and once in operation is rarely changed. This stability of operation fixes the airstream velocity and density as non-variable entities, allowing the airfoil shape, area and angle of attack to be designed to the specific operating condition. The angle of attack is made adjustable to permit optimization at time of installation, after which it is not changed unless made necessary by a major alteration of the operating conditions.

Knowing the desired web path between machine elements and the associated operating conditions, the profile and the area of the airfoil can be determined to optimize the process. The angle of wrap and the span between support points are of greatest importance in the airfoil selection. It should be noted that for the airfoil apparatus to function correctly, some directional change of the web is required. In a case where the angular displacement is zero (such as placement immediately preceding the tissue cleaner), the web may actually enter and exit the airfoil at the same elevation, as shown in FIG. 2, although the web does experience a momentary displacement from its straight line path. Where the airfoil is used to facilitate an angular displacement of the web path, the entry and exit are nearly tangential to the airfoil surface, following the airflow around the airfoil as it does in the case where no angular displacement is required and web stabilization is the only objective.

Also critical to the design of the airfoil in accordance with the invention is the fact that the web being manipulated is very light in weight and quite delicate. For example, a web typically ranging in weight from 8 to 12 lbs./3000 $ft^2$ in an unconstrained state can be buoyed by a column of air moving at only slightly over 100 feet per minute (the speed of a slow walk). Since the web tension is also held to an absolute minimum to prevent pulling the crepe out of the tissue, the web must be considered to be in the unconstrained state where it is easily manipulated by uncontrolled air movements. For instance, casual air emanating from the broke pit (which is usually located below the web) will cause the web to billow excessively if the free span is too great. The influences of these extraneous air sources must be considered in establishing the airfoil quantity and placement.

Since the tissue web is readily moved by these extraneous air currents, the airfoil web stabilizer of the invention is placed in the web path (and its associated boundary layer airstream) to take advantage of the Bernoulli effect in maintaining control over the transported web by drawing it toward the adjacent foil surface. In using the airfoil web stabilizer of the invention as a means of producing a change in angular direction, exerting a pull on the web is inherently stable while pushing the web (at very low tension) would most likely exhibit questionable stability. A properly applied foil design should be able to lift a web when positioned above it, as well as pull it down from a position below.

As the functional device of the web stabilization apparatus of the invention, the airfoil design is most critical. In principle, it must redirect the air (and thus, the web) with as little disturbance as possible, while at the same time providing a positive influence over the web. In choosing to apply aerodynamics to the control of the moving web, the first task is to look at the spectrum of airfoil designs and select those attributes which are suitable for the intended purpose. To the uninformed, the word "airfoil" conjures thoughts of the wings attached to a recreational light aircraft, and that the "wing" somehow magically lifts things. The fact is, the air flowing around the wing is doing the lifting by exerting its force over the area of the wing. An "airfoil" can be almost any shape imaginable, as long as it produces a reaction force of some magnitude by its displacement of the surrounding air flow.

Figure 3:
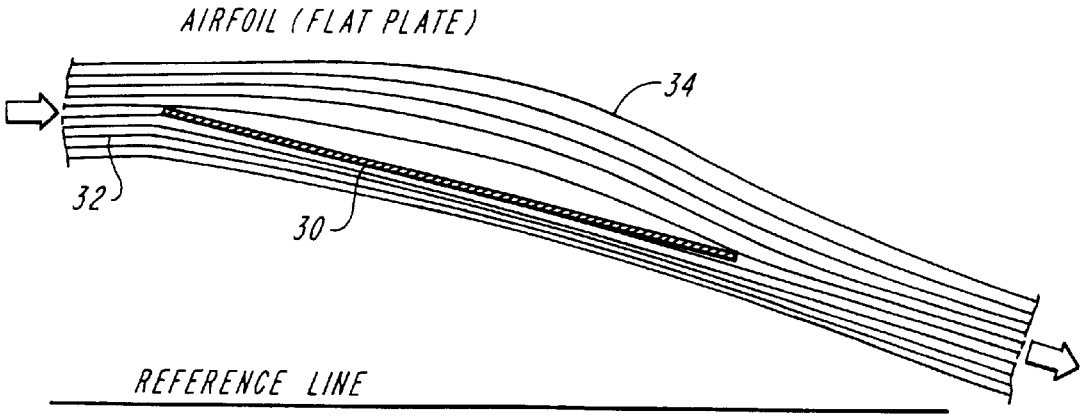
FIG. 3 a side view schematic airflow diagram for an exemplary flat plate airfoil.

The simplest embodiment of an airfoil design is that of a flat plate 30 as shown in FIG. 3. The force generated by the flat plate airfoil 30 is primarily due to the increase in relative airstream velocity on the upper side (Bernoulli effect), although the change in angular direction of the airstream 32 will generate some additional force. The flat plate is limited to relatively low angles of attack (angle relative to the reference line or entering airstream) in order to keep the airstream from breaking away from the surface and becoming turbulent, resulting in the reaction force being greatly diminished. As the angle of attack increases, the bubble 34 (curved path the air takes on the upper side) becomes larger and moves toward the exit end until the flow separates from the plate. Minor changes in the angle of attack can result in significant movement of the bubble, thus it is very likely that instability in operation could result from extraneous air currents in the area of the web. The flat plate is further limited by a structural strength conflict which puts thickness (preferably minimal) against stiffness, weight, and mounting complexity.

Figure 4:
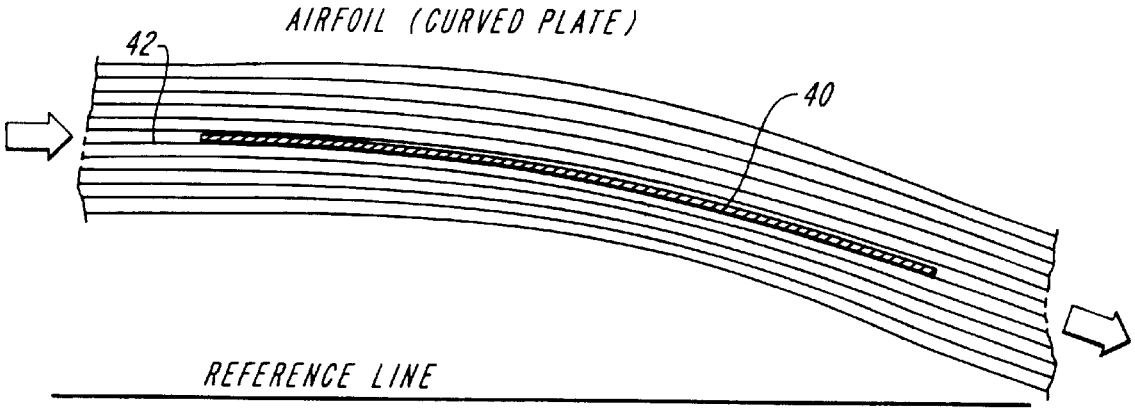
FIG. 4 is a side view schematic airflow diagram for an exemplary curved plate airfoil.

Another embodiment of the airfoil design is the curved plate 40 shown in FIG. 4. The curved plate derives most of its reaction force from the angular changes in direction of the airstream 42. Little force is generated by the Bernoulli effect, as the only increase in airstream velocity on the side farthest from the reference line is due to the lengthened path parallel to and outwardly stepped from the radius of curvature of the upper surface of the curved plate. The curved plate is a more stable airfoil design than the flat plate because the entry and exit airstreams are generally tangent to the curvature of the plate. This tangential flow avoids having the air change direction abruptly and therefore reduces the potential of the airstream separating from the surface.

The curved plate airfoil design could be applied as a device around which to transport a web in order to affect an angular change in direction, but its use would require a precise orientation and placement in the web run to assure that the entry and exit are tangential to the curvature. Should the web path be caused to enter or exit the curved plate airfoil at some angle other than on the ideal tangential path, flow separation, web instability or inadvertent contact may result.

Although the curved plate is an effective airfoil from an aerodynamic standpoint, it has structural limitations similar to those of the flat plate airfoil. The radius of curvature of the plate must be generous to avoid the flow separation typical of the flat plate. Additionally, if the ideal entry path is established, there would be little or no boundary layer air between the surface of the foil and the web, greatly increasing the probability that the web will make contact with the foil.

Figure 5:
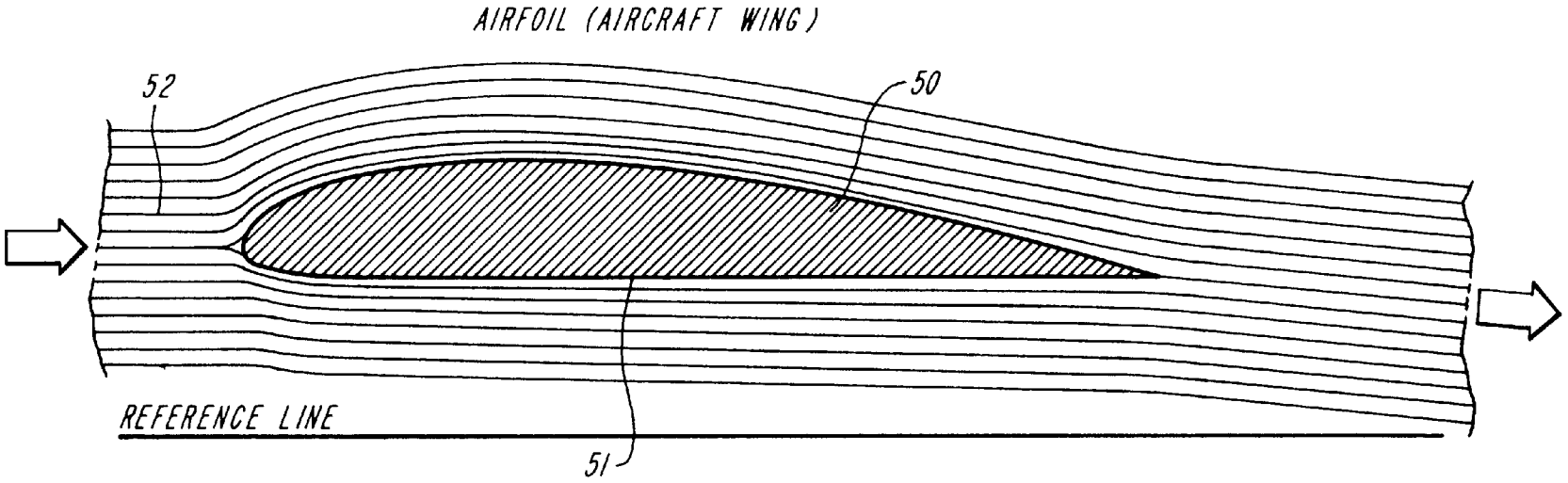
FIG. 5 is a side view schematic airflow diagram for an exemplary aircraft wing airfoil.

FIG. 5 shows another embodiment of an airfoil design, an aircraft wing type of airfoil 50 which is typically employed on low speed recreational light aircraft. This airfoil is both very stable and very efficient when compared to the flat plate and curved plate designs previously reviewed. Its reaction force is generated primarily by the Bernoulli effect (the airstream path length on the top is obviously greater) with some reaction force the result of angular displacement of the airstream leaving the airfoil. For illustrative purposes, the lower surface 51 of the airfoil shown in FIG. 5 is oriented parallel to the reference line and is nominally at a "zero" angle of attack. Even at this "zero" angle of attack, a substantial amount of force can be generated with this airfoil.

The airstream flow 52 around the aircraft wing type airfoil 50 is smooth on both sides, with the flows taking their respective paths after splitting at the rounded entry end and rejoining smoothly at the exit. With a properly proportioned airfoil, the airstreams remain attached through a wide range of angles of attack, with a greater angle of attack being possible before flow separation or instability occur. Within the dynamic limitations of this specific airfoil, as the angle of attack is changed, the streamlines shift position yet remain continuous until that point is reached where separation occurs.

With the aircraft wing type airfoil, the reaction force is maximized for the specific air velocity while at the same time the aerodynamic drag is minimized. Using a stationary airfoil with the air (and web) moving relative to it, the drag (tension) on the web is at a minimum. The well rounded entry end afforded by the aircraft wing type airfoil 50 allows a degree of forgiveness for inadvertent variations in approach angle which may occur on occasion due to extraneous air currents.

Figure 6A:
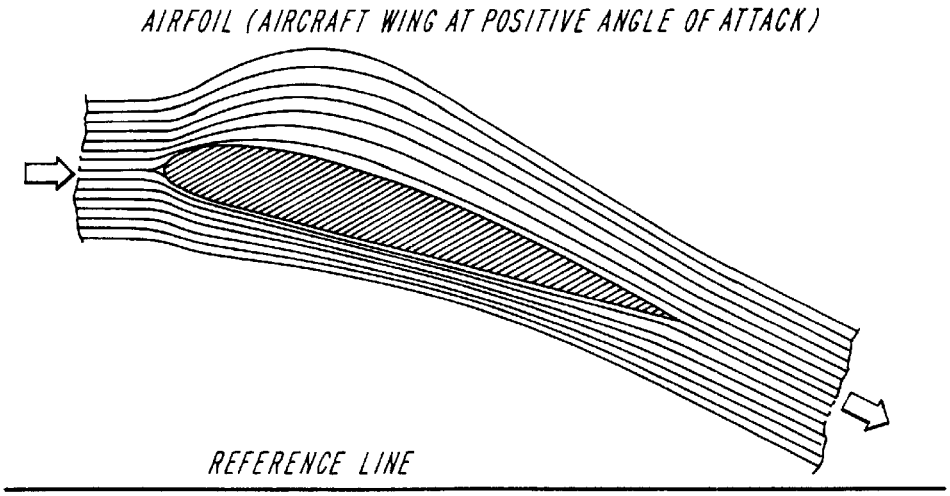
FIG. 6A is a side view schematic airflow diagram for an exemplary aircraft wing airfoil at a positive angle of attack.
Figure 6B:
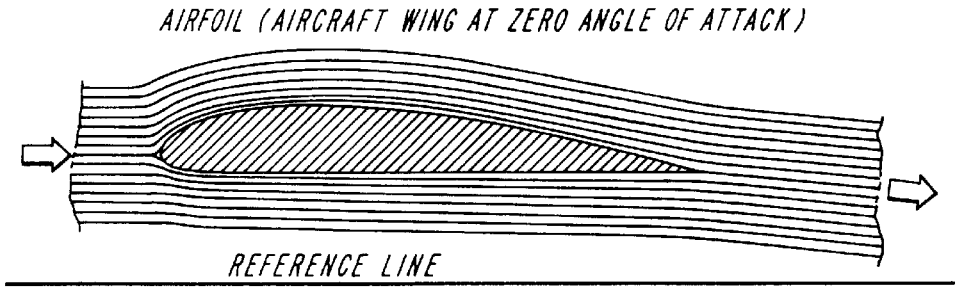
FIG. 6B is a side view schematic airflow diagram for an exemplary aircraft wing airfoil at zero angle of attack.
Figure 6C:
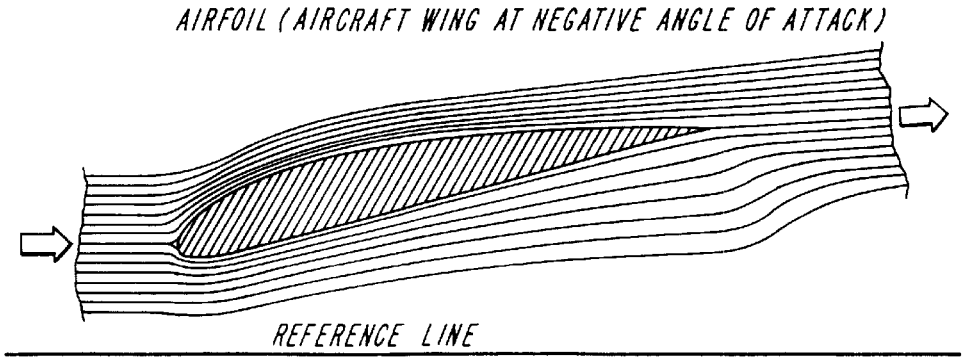
FIG. 6C is a side view schematic airflow diagram for an exemplary aircraft wing airfoil at a negative angle of attack.

Orientation of the aircraft wing type airfoil has an effect on the movement of the airstream past the airfoil. FIGS. 6A–6C show the comparative airstream flows for a typical aircraft type airfoil at various angles of attack. In these figures, the positive and negative attack angles shown are equal relative to the zero reference line.

Although the airfoil at a negative angle of attack will produce a reaction force similar to that of the positive angle airfoil, the reaction force distribution and the point of maximum airstream velocity is shifted toward the exit end of the airfoil prior to joining the airstream from the opposite side. This abrupt directional change produces some amount of aerodynamic drag force, which when applied as a device for web stabilization, is likely to result in some increase in the web tension. Ideally, the orientation of the exiting airstreams (and web) should be tangent to the leaving surface of the airfoil where the reaction force is minimum and the rejoining with the opposite side is accomplished smoothly.

As previously described, the aircraft wing type airfoil produces a positive reaction force even when its orientation to the airstream is at a zero angle of attack (flat bottom surface parallel to the reference line). If the airfoil is rotated about the entry end in such a fashion that the exit end is raised relative to the reference line, an angular change of approximately six degrees would be required (for the specific airfoil shown in FIGS. 6A–6C) to reduce the positive reaction force to zero and result in a net airstream flow which is essentially equal along both upper and lower surfaces. Effectively, this means that if a basic aircraft wing type airfoil (unchanged from that shown in FIGS. 6A–6C) were to be employed as a web stabilizer and placed such that the web path was on the bottom side of the airfoil (the flat side), a negative angle of attack somewhat greater than six degrees would be required to exert a reaction force adequate to maintain control over the web. Modifications to this basic airfoil shape can be employed to change the angle of attack characteristics and enhance overall performance and stability.

The initial embodiment of the web stabilizer design of the invention, referring back to FIG. 2, was a nearly symmetrical airfoil having a length to thickness ratio of approximately three. This shape provides a minimum of aerodynamic drag and is stable through a broad range of attack angles. The airfoil 20 was fabricated in such a fashion that there were no seams or discontinuities to disturb to smooth airflow on the web side. The intent of this airfoil was to provide web stabilization without significant alteration of the web path. As shown in FIGS. 7A–7B, construction consisted of two pieces, the first piece 70 comprising the entering end radius which then transitioned to the working (web side) surface curvature, and the second piece 72 which provides internal structural support and is shaped to form the opposite side surface to complete the airfoil profile. This fabrication methodology provided a functionally accurate airfoil that possessed adequate stiffness to resist twisting and bending.

With reference now to FIGS. 8, 9 and 10A–10C, a preferred embodiment of an airfoil web stabilizer 80 in accordance with the invention is shown. Using the same construction technique as shown in FIGS. 7A and 7B and applying the principles of airfoil aerodynamics, the airfoil web stabilizer 80 was designed using the same basic shape of the first design, with the active face of the airfoil lengthened to form an extended surface 86 which increases the total area. The extended surface is further lengthened with an extension flap 82. The lower surface of the airfoil, the extended surface 86 and the extension flap 82 combine to define an active surface 87 for the airfoil web stabilizer of the invention. It will be appreciated that the extended surface 86 can be configured as a flat or curved surface.

The construction consisted of two pieces, the first piece 81 comprising the entering end radius which then transitioned to the working (web side) surface and extension flap 82, and the second piece 83 which provides internal structural support and is shaped to form the opposite side surface to complete the airfoil profile.

The increase in total area intensifies the strength or reaction force capability, enhancing its effectiveness at lower web speeds (air velocity). Additionally, performance is improved in situations where there are strong outside air currents influencing the web. Enlarging the area also facilitates its use as a device for effecting changes in angular direction. Optimally, the web should enter and exit the airfoil web stabilizer tangential to its curvature. As the angle of wrap increases, the radius of curvature is decreased to maintain an area which is consistent with the reaction force required to retain control over the web.

The reaction force of the airfoil web stabilizer is effectively increased by the addition of the extension flap 82 at the exit end of the airfoil, as shown in FIG. 8. The increase in reaction force results from both the enlargement in effective area, as well as the increase in camber (curvature) of the total airfoil surface. The extension flap is positioned at an angle relative to the airfoil surface at the web exit point. The effective area of this flap is gradually reduced along its length by a series of tapered slots 84 through which air is induced to flow, providing a transition zone for the smooth release of the web from control of the airfoil web stabilizer. The flap of gradually reduced area also serves as a buffer to absorb disturbances which may be introduced to the web after it leaves the airfoil and which would otherwise adversely affect web stability. Under some conditions (low speed, etc.), the benefit of the tapered holes may diminish and they could be eliminated.

Figure 10A:
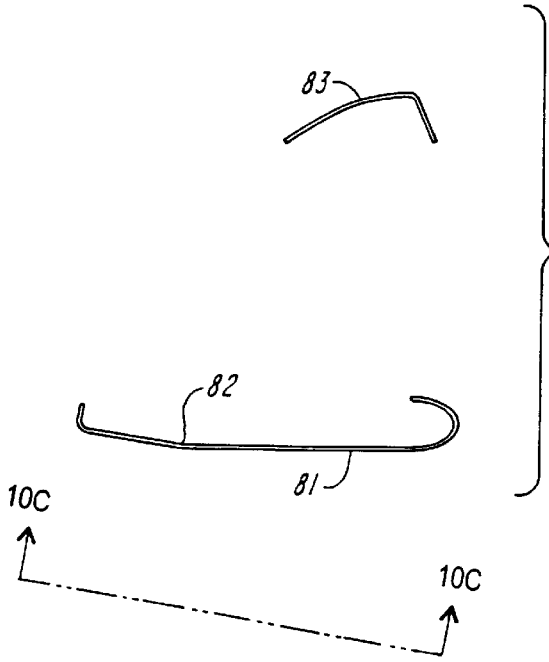
FIG. 10A is a side sectional view of the exemplary airfoil web stabilizer of the invention in a disassembled state.
Figure 10B:
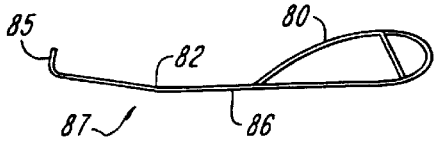
FIG. 10B is a side sectional view of the exemplary airfoil stabilizer of the invention in an assembled state.
Figure 10C:
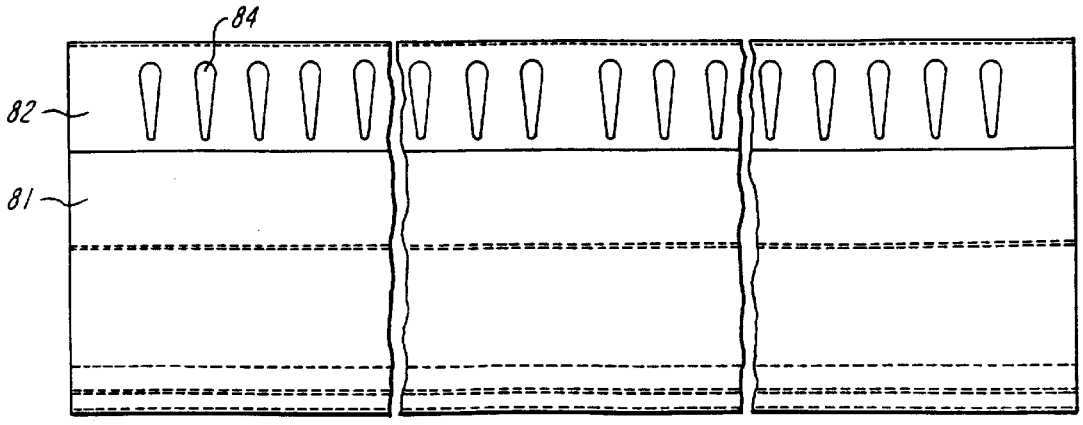
FIG. 10C is a sectional view of the airfoil web stabilizer of the invention taken along section line 10C—10C of FIG. 10A.

The trailing edge 85 of the extension flap 82 shown in FIGS. 8, 9 and 10C, is formed at approximately ninety degrees relative to the remainder of the flap, again extending the curvature of the airfoil. This formed section provides a substantial increase in the mechanical strength of the flap, which is inherently weakened by incorporation of the ventilation slots. By including the trailing edge in the flap, the straightness and positional uniformity of the flap is assured.

The use of the extension flap 82 with both ventilation slots 84 and trailing edge 85, which is set at some angle with respect to the tangent of the curved foil surface at the exit point, is exemplary and it will be appreciated by those of skill in the art that alternative configurations are possible. Since the flap angle (the angle the flap deviates from the plane of the bottom surface of the airfoil) is small, typically less than 15°, the airflow will follow onto the flap without sharply breaking away from the surface. By virtue of the Bernoulli effect, a low pressure is created that will draw air through the tapered slots in the flap surface. In order to reduce the potential for the web to be drawn into contact with the airfoil at the exit, the flap angle is reduced as the wrap angle of the foil is decreased.

Use of the proper angle is critical, since the forces are inversely proportional to the effective radius of curvature and as the wrap angle is diminished, the force required to maintain control of the web as it exits is reduced. For a low angular displacement stabilizer foil, an excessive flap angle may encourage the web to contact the surface of the foil at the juncture of the airfoil proper and the extension flap. Similarly, the transition between the entering end curvature and the primary foil curvature must be as gentle as practical to reduce the tendency of the web to make contact at that point. In the fabrication of the airfoil web stabilizer, to minimize the contact pressure if the web makes contact with the airfoil, it is essential that all transitions be made smoothly, since any sharp change in shape may result in airflow instability and excessive contact friction.

Figure 11:
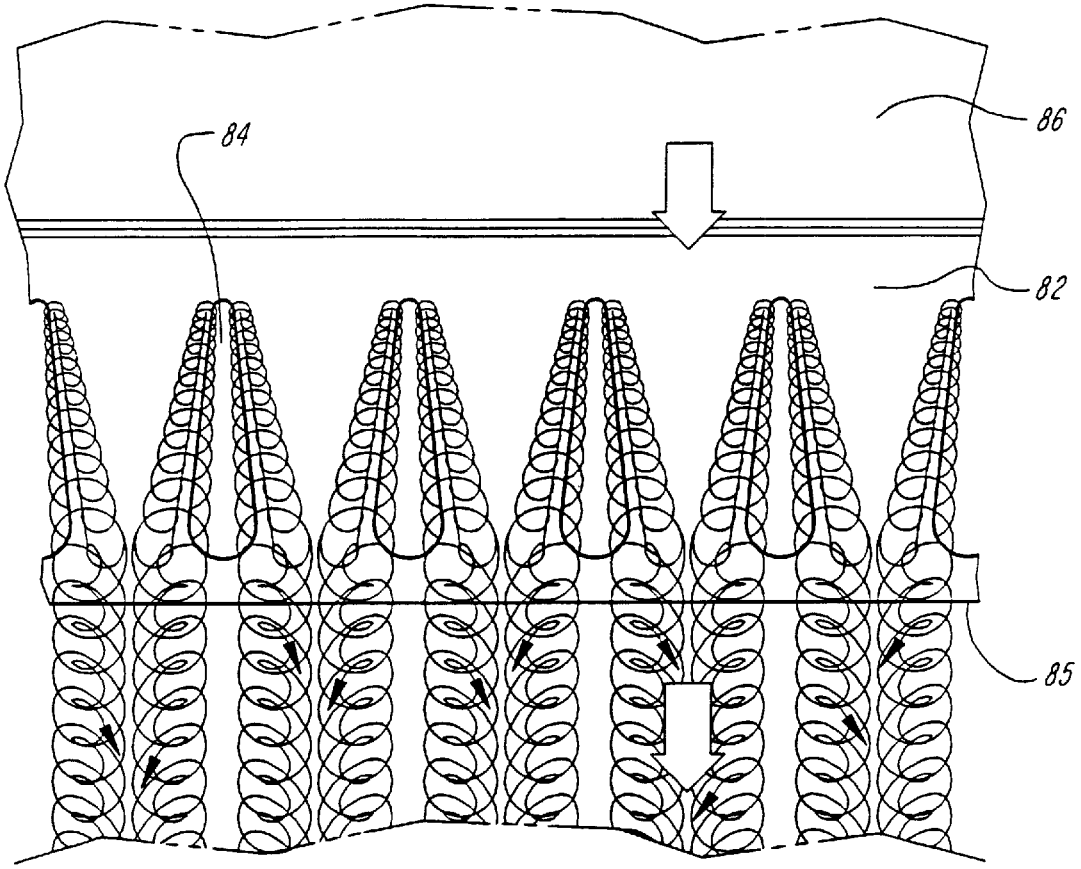
FIG. 11 shows a schematic airflow diagram of an exemplary extension flap with tapered vent slots of the invention.

The use of a variable width slot 84 which is narrowest near the point of tangency, causes a proportioned amount of air to be aspirated through the slots. This aspirated air spills into the triangularly shaped area bounded on two sides by the tangent line and the flap, as it tries to establish a condition of equilibrium pressure on both sides of the flap. The size, shape and placement of these tapered slots are intended to induce formation of a complex series of counterrotating airstreams (vortices) as shown in FIG. 11. In the formation of each vortex, that portion of the local airstream passing through the slot is changed in its orientation from being linear to a path having high angular velocity, with the rotational speed and radius being a function of the airspeed and the design specifics. Effectively, the rotating shafts of air give the adjacent airstream a degree of rigidity, much as the airfoil does when it is in proximity. These vortices interact with the airstream (and web) to gently control it, acting much like a myriad of aerodynamic strings attached to the web. The rotational velocity of each vortex is gradually diminished as it expands or is consumed by out-of-plane undulations of the web and aerodynamic friction. Once this kinetic energy has been dissipated, the vortices cease to exist and the web (and airstream) returns to its indigenous path until influenced by the next element of the apparatus.

The web carries the airstream along with it in the form or a boundary layer which is far from uniform. For applications where the stabilizer is only a foot or two down stream of the preceding piece of equipment, the boundary layer will not even be as thick as the airfoil. The stationary stabilizer does nothing until it begins to become immersed in the moving boundary layer and it is the presence of the web itself that creates the conditions for a significant suction effect.

Boundary layer thickness for flows adjacent to stationary flat plates are defined mathematically in most fluid dynamics texts as a function of the distance from the leading edge of the plate. This provides a means of approximating what to expect with a moving web. In this case, there is no leading edge but it can be assumed that boundary layer build up starts at some obstruction which will remove a previous boundary layer, such as a roll or doctor.

Figure 12:
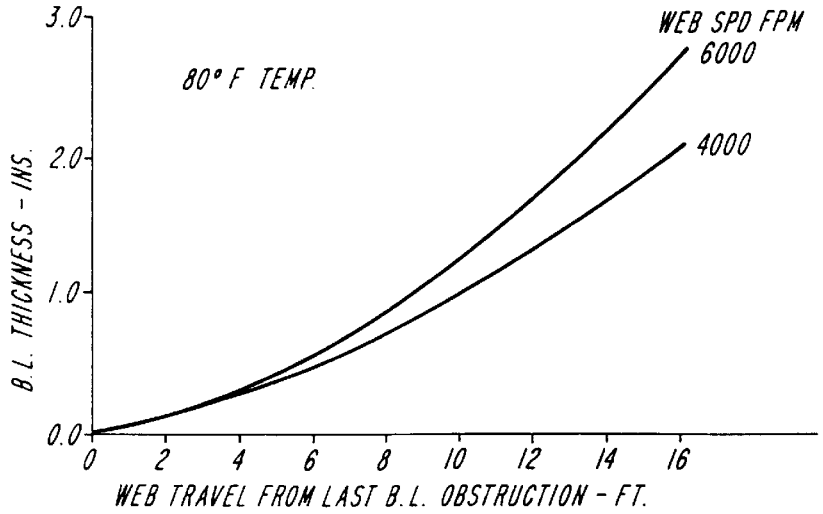
FIG. 12 Prior Art
FIG. 12 shows a graph of boundary layer thickness based on smooth flat plate analysis.

FIG. 12 is a graph of the boundary layer thickness based on smooth flat plate analysis, and thus shows calculated values for smooth surfaces. Smoke testing of webs suggests that boundary layers are rather thicker than indicated in the graph which may be due to the effect of surface roughness. The speed range shown is typical for tissue machines. For short web travel distances of a few feet, boundary layers are indicated to be less than half an inch.

Figure 13:
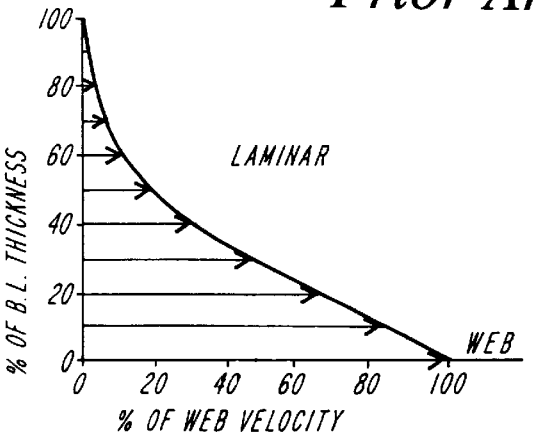
FIG. 13 is a graph of boundary layer velocity profile for laminar flow.
Figure 14:
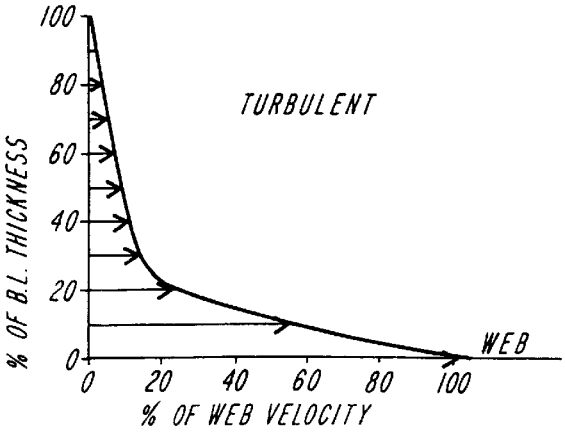
FIG. 14 is a graph of boundary layer velocity profile for turbulent flow.

Calculated velocity distribution across the boundary layers are shown in FIGS. 13 and 14 for laminar and turbulent flow conditions, respectively. The non-uniformity of flow velocity is clearly shown. It is also evident that velocities decay to values much below web speed in less than half of the boundary layer thickness. For practical dimensions, it is clear that the boundary layer will rarely engulf the stabilizer but it is more likely to try to cram itself between the web and the stabilizer active surface.

Figure 15:
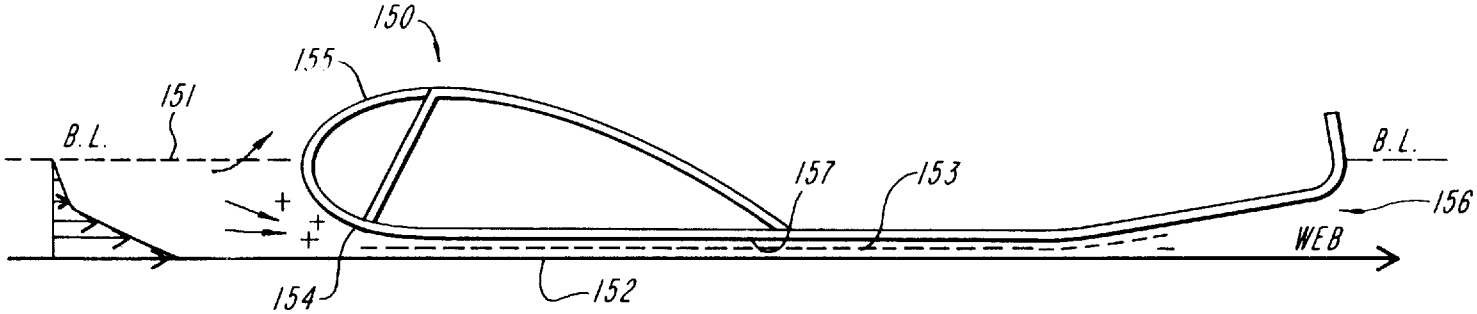
FIG. 15. shows a side view schematic airflow diagram for an exemplary airfoil web stabilizer in accordance with the invention.

With the airfoil stabilizer 150 dipped into the boundary layer 151 being carried by the web 152 as illustrated in FIG. 15, a bounded channel 153 is created. With the boundary layer thicker than this channel, all of its air cannot be accommodated and the pressure at the stabilizer leading edge 154 will tend to rise (stagnation). Some of the air will be pushed away from this interface to flow over the top side 155 of the airfoil, but some will accelerate as it moves into the channel. Because of air friction due to viscosity, the web acts to pump air through the channel and away from the exiting end 156. The resulting pressure gradient along the channel enhances an elevated air flow velocity and a below ambient static pressure. The web moves closer to the stabilizer.

A higher flow velocity and narrower gap increases the air friction against the stabilizer active surface 157. At some point this load will equal the pumping capability of the web and tend to establish ambient pressure in the channel 153 and an equilibrium gap. For a given web speed, boundary layer thickness and stabilizer geometry, the gap wants to be unique.

For a tissue web, a negative pressure in the channel will tend to pull air through the web. The drag of this flow pulls the web 152 toward the stabilizer 150. Conversely, a positive pressure in the channel will cause air to leak away through the web and thereby drag it away from the stabilizer. Both effects strive for equilibrium with ambient pressure in the same sense as a pressure gradient across a non-porous web.

Figure 16:
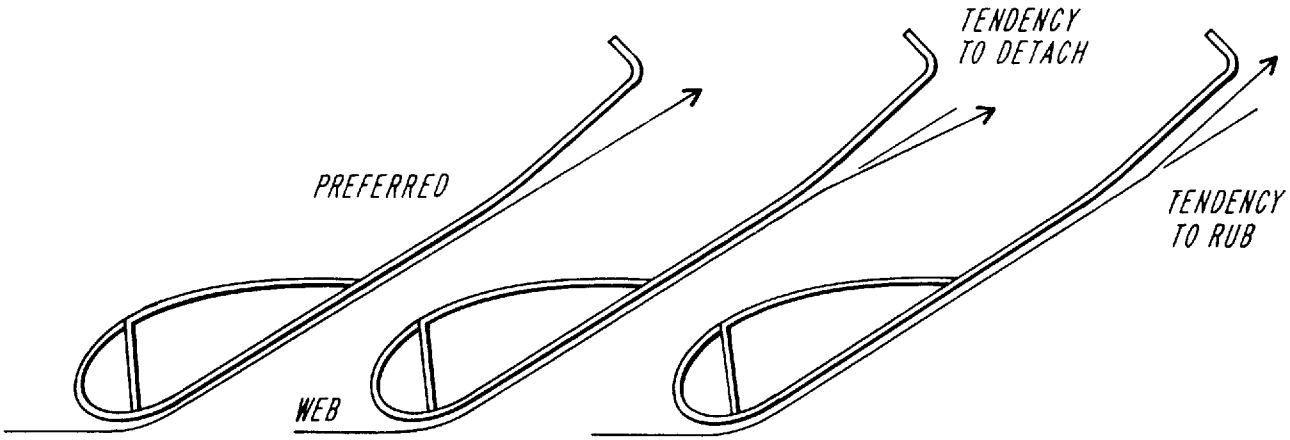
FIG. 16 show side view schematic diagrams of an exemplary airfoil web stabilizer with various web exit paths.

As illustrated in FIG. 15, if the nose or front end of the stabilizer 150 is held in position adjacent to the web and the trailing edge is lifted, the web will tend to remain attached to the stabilizer until another force seeks to break the adhesion. The direction and magnitude of web tension can create this other force. Since the aerodynamic forces involved are weak, best results obtain if the web leaves the trailing end substantially parallel to the flat active face of the stabilizer. If the web leaves at an angle away from the plane of the stabilizer, it will tend to detach. If it leaves at an angle toward the plane of the stabilizer it will tend to rub. These effects are shown in the three diagrams illustrated in FIG. 16.

The details of the trailing end configuration with its tapered perforations is described heretofore, and relate to an orderly separation of the web from the stabilizer. The need for the tapered perforations is related to the porosity of the web. Experiments have shown that a porous web is forgiving at this detachment area and the perforations are not necessarily needed for optimum operation.

At the leading end of the stabilizer, redirecting the web path results in the web wrapping around the nose of the airfoil shape and leaving at a different tangency point. Even so, the higher velocity portion of the boundary layer continues to flow preferentially towards the channel between the web and the stabilizer active surface and the attachment mechanism functions as previously described. Experience has shown that the device is very tolerant of this leading edge wrap.

Figure 17:
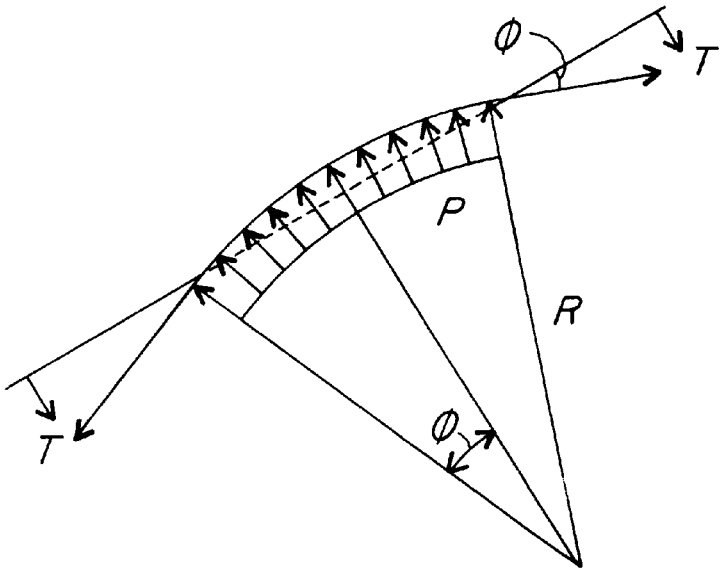
FIG. 17 shows a force balance diagram.

The force balance for a web wrapped around a circular arc and supported by uniform pressure within the arc is shown in FIG. 17 and defined by the following equation.

$$P=27.7\ (T/R)$$

where P is the pressure in inches of water column, T is web tension in pounds per linear inch and R is radius of curvature of the arc in inches.

Figure 18:
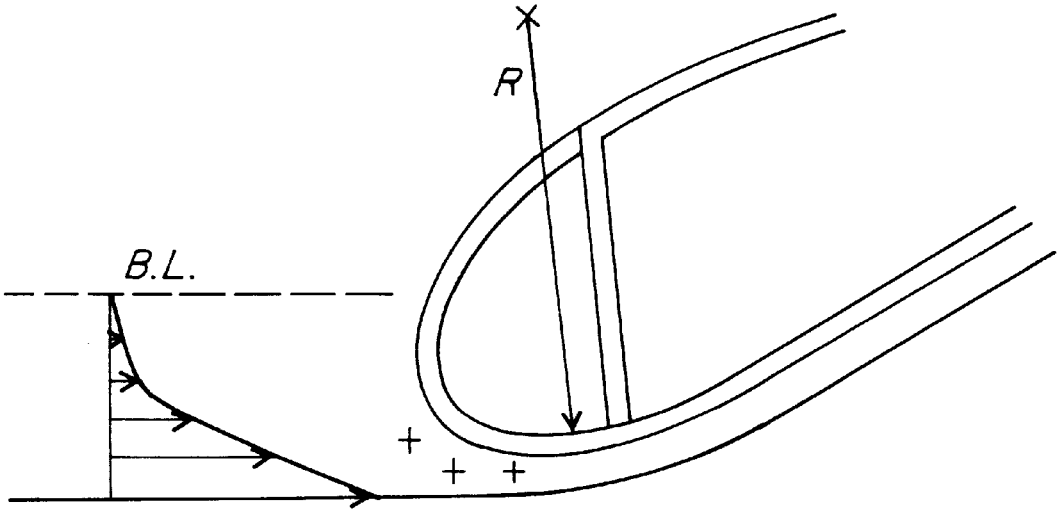
FIG. 18 shows a side view schematic diagram of an exemplary airfoil web stabilizer corresponding to the force balance diagram of FIG. 17.

The angle of the arc has no effect as long as the supporting pressure is uniform. The leading end of the airfoil web stabilizer provides such an arc. In fact, the airfoil shape has a leading edge arc that starts off fairly small and increases along the bottom surface until it blends into the flat active surface as shown in FIG. 18. As the equation shows, the support pressure needed increases as the curvature radius decreases.

For very low web tension, there is just about enough stagnation pressure in the web boundary layer to avoid contact with typical stabilizer nose dimensions at moderate wrap angles below about 20 degrees. In practice, the preferred flat design, in tissue applications, will experience light but acceptable contact in this region even with greater wrap angles. For applications where minimal contact is preferred, curved configurations can be considered where the whole bottom active surface forms a large curvature arc.

Figure 19:
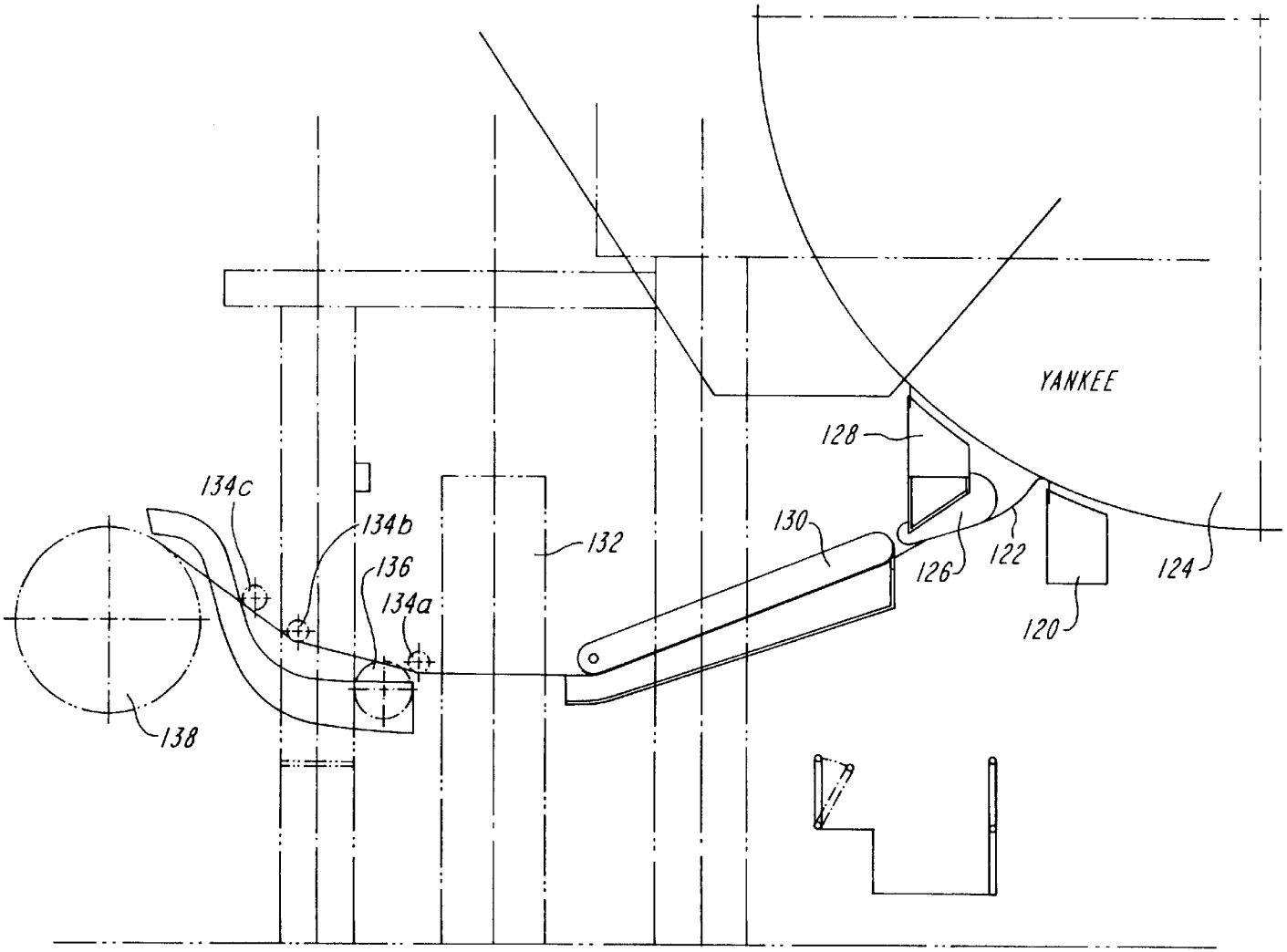
FIG. 19 shows a schematic side view of a conventional paper making machine.

The non-powered airfoil web stabilizer finds its application very well suited as a device to control the behavior of light weight paper webs as they are transported between a dryer roll (Yankee) on the paper machine and a reel drum where it is wound into rolls for subsequent processing. FIG. 19 is a side elevation schematic view of that space across which the web must be transported on a typical paper machine for the manufacture of tissue.

The primary components of such a machine include a creping doctor 120 which literally scrapes a web 122 from a Yankee roll 124, bunching it to increase its bulk. A slipper 126 is mounted to a cut-off doctor 128 and serves as a guide to minimize potential of the web getting to the top side of a foil 130 arrangement which, in turn, guides the web to a beta gauge 132. After the beta gauge, the web passes under a pipe roll 134*a* and through a slitter 136 where the web is cut into multiple narrower widths, under additional pipe rolls 134*b*, 134*c* and onto a reel drum 138.

Figure 20:
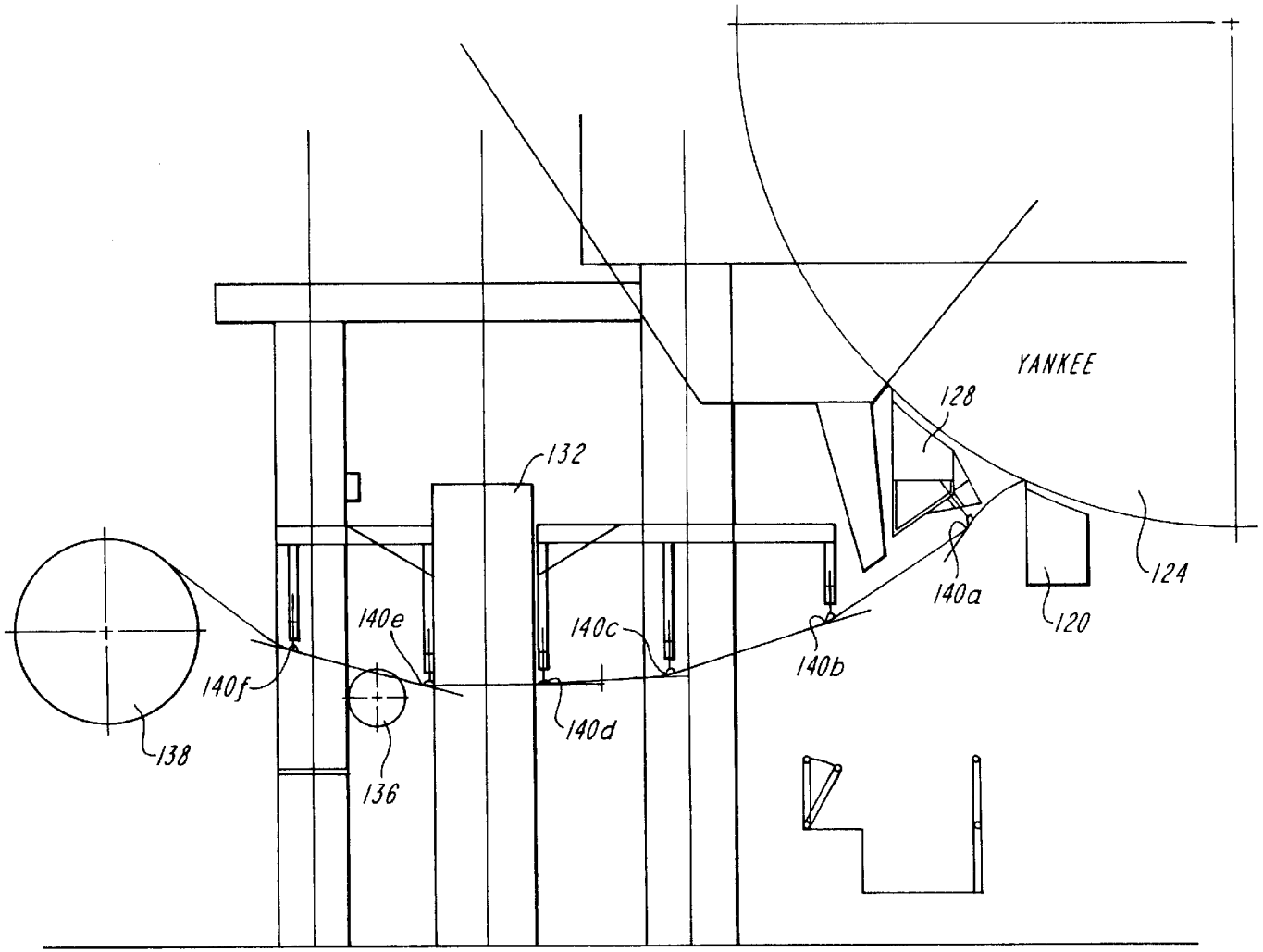
FIG. 20 shows a schematic side view of a paper making implementing the exemplary airfoil web stabilizers of the invention.
Figure 21A:
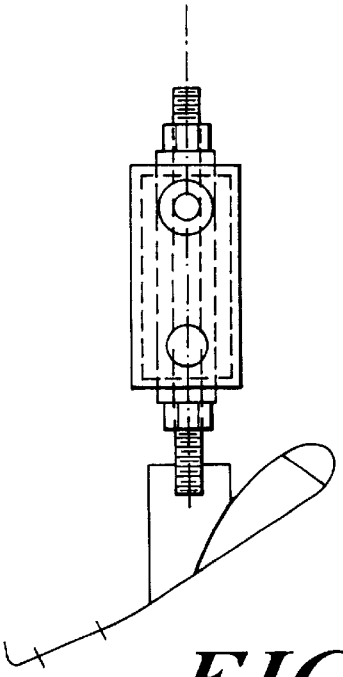
FIG. 21 A is a schematic side view of an exemplary support structure for the airfoil web stabilizer of the invention.
FIG. 21B is a schematic frontal view of an exemplary support structure for the airfoil web stabilizer of the invention.
Figure 22A:
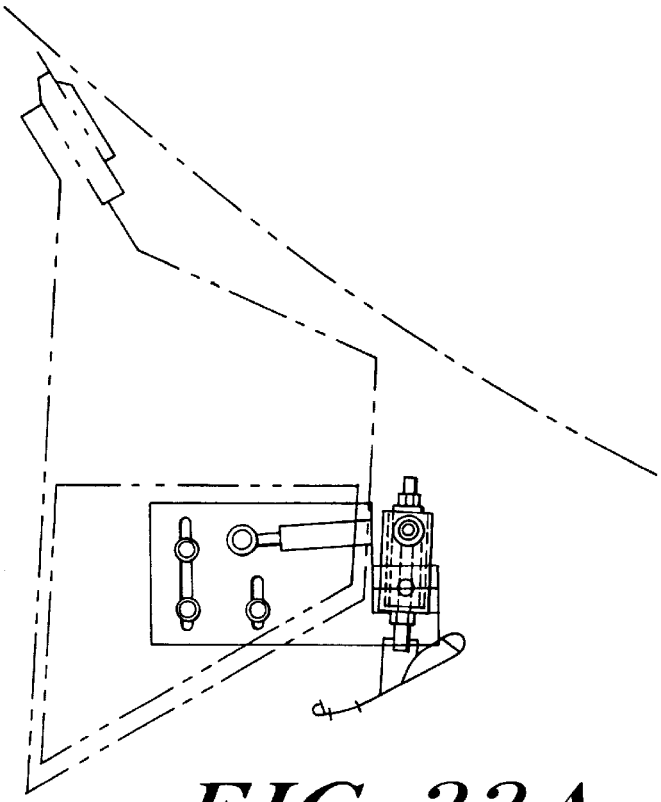
FIG. 22A is a schematic side view of an exemplary mounting arrangement for the airfoil web stabilizer of the invention.
Figure 21B:
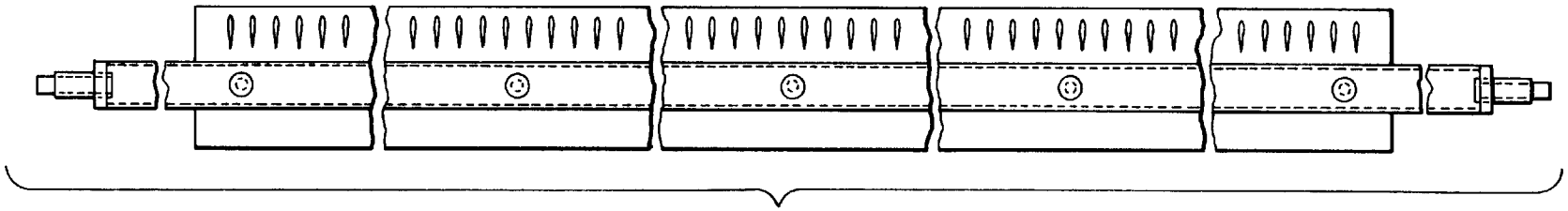
Figure 21C:
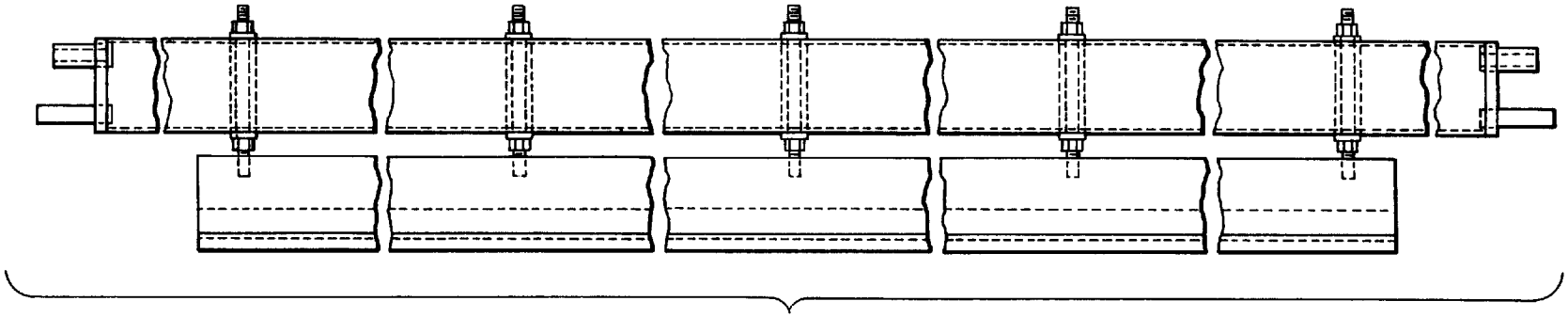
Figure 22B:
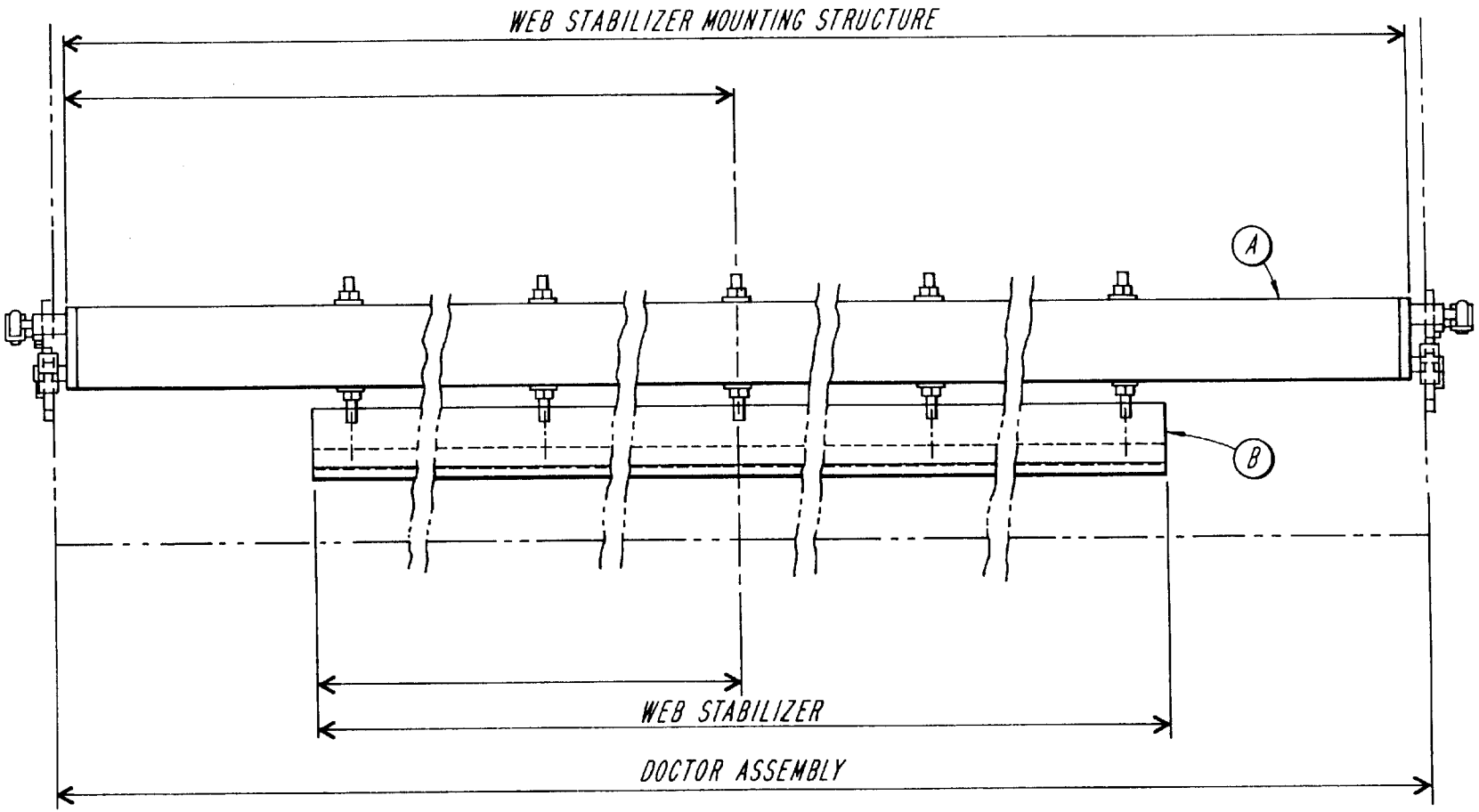
FIG. 22B is a schematic frontal view of an exemplary mounting arrangement for the airfoil web stabilizer of the invention.

FIG. 20 shows a similar side elevation schematic view as that of FIG. 19, except that the slipper, foil, and pipe rolls have been removed and replaced by the non-powered airfoil web stabilizers 140*a–f* in accordance with the invention. For clarity, the thread tube system is not shown, but would be positioned to compliment the stabilizers.

Since the airfoil web stabilizers of the invention are designed to be bowed without buckling and are not necessarily very strong, the foils must be mounted to a fabricate structure which is, in turn, attached to an available rigid machine element which is outside of the web path. FIGS. 21A-C and 22A-B respectively show an exemplary support structure and mounting arrangement for the airfoil web stabilizers of the invention.

To locate the airfoil web stabilizers for the desired web passage, each stabilizer foil is attached to the structure at multiple points along the cross machine width to permit vertical adjustment (alignment) as well as angular adjustment (angle of attack). These attachment points are designed to minimize interference with the airflow over the back side of the airfoil web stabilizer.

It will be appreciated by those of skill in the art that the non-powered airfoil web stabilization apparatus of the invention is not limited to use on paper machines manufacturing tissue. This apparatus can be effectively used for positional control of any web moving at high speed, provided the free span between machine elements is great enough to permit formation of a layer of boundary air which can be manipulated by the airfoil.

Accordingly, it will be appreciated that the airfoil web stabilization apparatus of the invention has several unique features. The invention serves to aerodynamically manipulate the web path. The web path is controlled by redirection of the boundary layer air which accompanies a web moving at high speed. The airfoil web stabilization apparatus is non-powered and does not utilize an external air supply to support the web while turning at low tension without physical contact. The trailing edge flap arrangement of the airfoil with vortex inducing tapered slots absorbs web vibrations and dampens minor out-of-plane web undulations while providing a smooth release from the controlling surfaces. The area and shape of the airfoil web stabilizers of the invention are varied (can be optimized) according to the web speed and angle of turn. The design principle of the non-powered airfoil web stabilization apparatus of the invention is control of the moving web by manipulation of the boundary layer air surrounding the web, thus any size or shape of airfoil having that property can be used. The airfoil web stabilizer can be used in place of a bowed roll to tighten the web in a cross machine direction and remove sheet wrinkles with minimal contact. The mounting arrangement is designed to offer a minimum of impedance to airflow around the entire airfoil. The mounting arrangement also provides the ability to adjust the angle of attack of the airfoil web stabilizer to optimize web control for the specific operating conditions encountered.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. An apparatus for stabilizing and changing the direction of a web moving along a path between web handling devices, said apparatus comprising:

an airfoil having a bulbous front end tapering to a narrowed rear end, said airfoil having first and second oppositely facing surfaces that are free of restricted openings for the passage of pressurized gas; and a tail surface extending from said rear end of said airfoil to define a continuous active surface with said second surface of said airfoil, wherein said web being arranged to move in spaced relation with and along said active surface such that the interaction between said active surface and boundary layer air associated with said moving web serves to both stabilize and alter the direction of said boundary layer air and said moving web.

2. The apparatus of claim 1, wherein said second surface and said tail surface further define an entry region for said moving web proximate to said second surface of said bulbous front end, and an exit region proximate to an end of said tail surface which is distal from said rear end.

3. The apparatus of claim 2, wherein said tail surface comprises a plurality of ventilation slots therethrough.

4. The apparatus of claim 3, wherein said ventilation slots are positioned proximate to said distal end of said tail surface.

5. The apparatus of claim 4, wherein said ventilation slots are tapered from a narrow opening to a wider opening proximate to said distal end.

6. The apparatus of claim 3, wherein said ventilation slots are operable for accommodating stable passing of said moving web from said exit region.

7. The apparatus of claim 2, wherein said tail surface comprises a flanged edge at said distal end which extends orthoganally with respect to said active surface.

8. The apparatus of claim 1, wherein said first and second surfaces of said airfoil are curved.

9. The apparatus of claim 8, wherein said tail surface comprises a portion proximate to said rear end which forms a continuous arc with the curve of said second surface of said airfoil.

10. The apparatus of claim 9, wherein said tail surface comprises an extension flap which extends from the end of said continuous arc portion.

11. The apparatus of claim 10, wherein said extension flap deviates from the curve of said active surface by a selected angle relative to the tangent of the curve of said active surface at the junction of said continuous arc portion and said extension flap.

12. The apparatus of claim 1, wherein said first surface of said airfoil is curved and said second surface includes a region which is relatively flat.

13. The apparatus of claim 12, wherein said tail surface comprises a portion proximate to said rear end which forms a continuous flat surface with said flat portion of said second surface of said airfoil.

14. The apparatus of claim 13, wherein said tail surface comprises an extension flap which extends from the end of said continuous flat surface portion.

15. The apparatus of claim 14, wherein said extension flap deviates from the continuous flat surface portion of said active surface by a selected angle.

16. An apparatus for stabilizing and changing the direction of a web moving along a path between spaced web handling devices, said apparatus comprising:

an airfoil having a bulbous front end and a rearwardly extending tail, said front end having first and second oppositely facing surfaces that are free of restricted openings for the passage of pressurized gas, with said tail providing a continuation of and coacting with said second surface to define continuous active surface; and means for positioning said airfoil adjacent said path at a position in which said web moves in spaced relation with and along said active surface such that the interaction between said active surface and boundary layer air associated with said moving web serves to both stabilize and alter the direction of said boundary layer air and said moving web.

17. The apparatus of claim 16, wherein said second surface and said tail surface further define an entry region for said moving web proximate to said second surface of said bulbous front end, and an exit region proximate to an end of said tail surface.

18. The apparatus of claim 17, wherein said tail surface comprises a plurality of ventilation slots therethrough.

19. The apparatus of claim 18, wherein said ventilation slots are positioned proximate to said distal end of said tail surface.

20. The apparatus of claim 19, wherein said ventilation slots are tapered from a narrow opening to a wider opening proximate to said distal end.

21. The apparatus of claim 18, wherein said ventilation slots are operable for accommodating stable passing of said moving web from said exit region.

22. The apparatus of claim 17, wherein said tail surface comprises a flanged edge at said distal end which extends orthoganally with respect to said active surface.

23. The apparatus of claim 16, wherein said first and second surfaces of said airfoil are curved.

24. The apparatus of claim 23, wherein said tail surface comprises a portion which forms a continuous arc with the curve of said second surface of said airfoil.

25. The apparatus of claim 24, wherein said tail surface comprises an extension flap which extends from the end of said continuous arc portion.

26. The apparatus of claim 25, wherein said extension flap deviates from the curve of said active surface by a selected angle relative to the tangent of the curve of said active surface at the junction of said continuous arc portion and said extension flap.

27. The apparatus of claim 16, wherein said first surface of said airfoil is curved and said second surface includes a region which is relatively flat.

28. The apparatus of claim 27, wherein said tail surface comprises a portion which forms a continuous flat surface with said flat portion of said second surface of said airfoil.

29. The apparatus of claim 28, wherein said tail surface comprises an extension flap which extends from the end of said continuous flat surface portion.

30. The apparatus of claim 29, wherein said extension flap deviates from the continuous flat surface portion of said active surface by a selected angle.

31. A method of stabilizing and changing the direction of a web moving along a path between spaced web handling devices, said method comprising:

providing an airfoil having a bulbous front end and a rearwardly extending tail, said front end having first and second oppositely facing surfaces that are free of restricted openings for the passage of pressurized gas, with said tail providing a continuation of and coacting with said second surface to define a continuous active surface; and positioning said airfoil adjacent said path at a position in which said web moves in spaced relation with and along said active surface such that the interaction between said active surface and boundary layer air associated with said moving web serves to both stabilize and alter the direction of said boundary layer air and said moving web.

* * * * *